US006829853B2

(12) United States Patent
Kim

(10) Patent No.: US 6,829,853 B2
(45) Date of Patent: Dec. 14, 2004

(54) TRAFFIC SIGN DEVICE

(75) Inventor: Yong Soo Kim, Goyang (KR)

(73) Assignee: Hanyang Frame Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/439,609

(22) Filed: May 15, 2003

(65) Prior Publication Data

US 2003/0213152 A1 Nov. 20, 2003

(30) Foreign Application Priority Data

May 20, 2002 (KR) ..... 2002-0027776
May 20, 2002 (KR) ..... 2002-0027778

(51) Int. Cl.[7] ..... G09F 15/00

(52) U.S. Cl. ..... 40/607.14; 40/612; 248/214; 248/218.4

(58) Field of Search ..... 40/607.14, 612, 40/572, 606.08, 610, 616; 248/214, 218.4, 219.3, 231; 116/63 R; 340/119

(56) References Cited

U.S. PATENT DOCUMENTS

| | | | | |
|---|---|---|---|---|
| 3,586,280 A | * | 6/1971 | Parduhn | 248/214 |
| 3,764,099 A | * | 10/1973 | Parduhn | 248/214 |
| 3,854,685 A | * | 12/1974 | Parduhn | 248/214 |
| 4,142,173 A | * | 2/1979 | Gould et al. | 248/214 |
| 4,246,715 A | | 1/1981 | Nelson | 40/607 |
| 4,342,168 A | | 8/1982 | Schmanski | 40/607 |
| 5,088,672 A | * | 2/1992 | Neuendorf et al. | 248/218.4 |
| 5,634,619 A | * | 6/1997 | Alessi | 248/219.3 |
| 5,974,712 A | | 11/1999 | Kallionpaa | 40/612 |

FOREIGN PATENT DOCUMENTS

| | | |
|---|---|---|
| JP | 7-317026 | 12/1995 |
| JP | 11-172639 | 12/1997 |
| JP | 10-168835 | 6/1998 |
| JP | 10-331118 | 12/1998 |
| JP | 2001-032225 | 2/2001 |
| JP | 2001-049628 | 2/2001 |
| KR | 1996-0009278 | 10/1996 |
| KR | 1998-009420 | 4/1998 |
| KR | 20-0167877 | 11/1999 |
| KR | 20-0265849 | 2/2002 |

* cited by examiner

*Primary Examiner*—Lars A. Olson
(74) *Attorney, Agent, or Firm*—Sheridan Ross PC

(57) ABSTRACT

A traffic sign device is disclosed. The device includes a post clamp mounted on a post installed on a roadside, a support bar radially coupled to an outer surface of the post clamp to be horizontally positioned, and a sign board coupled to one end of the support bar for exhibiting a desired road sign. The post clamp includes a pair of arched clamping bands hingedly coupled to each other. The support bar includes a socket pipe joined to the post clamp by welding, and a movable pipe slidably inserted into the socket pipe with its one end joined to the sign board. A bolt is fixed to the socket pipe through joint holes formed therein to secure the movable pipe at a desired position. The sign board includes a barrel-shaped band frame having a coupling slot through which the free end of the support bar passes and being fixed therein. Since the joint portion is positioned inside the sign board, coupling part in the sign board is effectively prevented from being exposed. This allows the sign board to have an excellent structural strength, and an acceptable appearance for a long period of time.

13 Claims, 16 Drawing Sheets

- PRIOR ART -

- PRIOR ART -

TRAFFIC SIGN DEVICE

BACKGROUND OF THE INVENTION

1. Field of the Invention

The present invention relates to a traffic sign device installed on a roadside post to exhibit various restrictions, directions, and warning on the road required for traffic safety or to show information regarding street names or location of a destination for convenience of drivers or pedestrians, and more particularly to a structure of a traffic sign device which allows a sign board to be easily attached to a post and which improves durability of the sign device with an acceptable appearance.

2. Description of the Prior Art

In general, various road signs are installed on roadsides or above roads to show drivers and pedestrians information relating to a road and cautions in order to assure safety and smooth driving conditions, and which are further intended to provide drivers with information relating to use of a road to preserve the structure of the road.

Such a road sign is manufactured into a designated shape and size and installed according to the law so that the contents of the sign are shown in characters, signs, and a combination thereof.

Further, the road sign can be classified into three categories, that is, a cautionary sign which warns drivers and pedestrians of dangerous circumstances of a road and required precautions, a restrictive sign which forces them into a designated action, and a directive sign which notifies them of progressing direction or a distance to a destination, according to the nature of its communicative particulars.

Accordingly, the road sign should be installed properly to allow drivers and pedestrians to distinctly recognize its communicative information in the far distance and even at night.

Moreover, various road guide signs are installed on roadsides to show drivers and pedestrians information relating to a road, such as progressing direction of a road, a distance to a destination, and a destination point, for the drivers' and pedestrians' convenience.

According to the scale of a road, the above-mentioned road signs and road guide signs (hereinafter called "traffic sign") assume the form of monopole or double-pole support. The monopole type traffic sign is supported on a post in a roadside in a cantilever manner. The double-pole type traffic sign is supported on a horizontal bar laid across two posts that are set on both sides of the road. Usually, the monopole type traffic sign prevails over the double-pole type one except highway and freeway.

A conventional monopole type traffic sign device is shown in FIGS. 1A and 1B. A traffic sign board 3 is mounted on a cantilever beam or hanger 2 fixed to an upper part of a post "P". To this end, as shown in FIG. 1A, the sign board 3 has at its rear side a plurality of guide rails 4 attached thereto. The guide rails 4 are coupled to a vertical extension of the hanger 2 by inserting a head portion of a bolt 7 into the channel of the guide rail 4 and placing a. U-shaped band 5 on both ends of the hanger extension to fasten the bolt 7 with a nut 8 at each flange 6 of the U-shaped band 5, as illustrated in FIG. 1*b*. The end of cantilever hanger 2 is fixed to a band clamp 1, so that the hanger 2 is horizontally supported on the post "P".

Such a structure of conventional traffic sign device can be found in Korean Laid-open Patent Publication No.1999-79008 and Korean Registered Utility Model Publication No. 20-0195042.

However, since the conventional structure for supporting traffic sign has the guide rails 4 attached to the rear side of the sign board 3 and the U-shaped bands 5 for coupling the sign board to the hanger 2, the U-shaped bands 5 must be fastened by the bolts 7 and nuts 8 at both its ends after assembling the bolts 7 in the guide rails 4, an operation of establishing the traffic sign on the post "P" is considerably complicated.

Though the respective components are manufactured by iron material and then coated with paint, the components are apt to be oxidized and corroded due to aging of the paint at their coupled portions, thereby causing contamination of the post "P" and reduction of service life of the traffic sign.

Furthermore, since the sign board 3 is formed into thin plate and the assembly of the guide rails 4 and bolts 7 are exposed to the public, scenery of roads is significantly spoiled. Additionally, the sign board 3 is apt to be deformed due to its poor structural strength.

To overcome these problems of the conventional traffic sign device, various traffic sign devices are proposed in publications, for example, Korean Registered Utility Model Publication No. 1996-9278, Korean Laid-open Utility Model Publication No. 1998-9420, Korean Registered Utility Model Publication Nos. 20-0167877 and 20-0265849, and Japanese Laid-open Patent Publication No. H10-168835.

In the Korean Registered Utility Model Publication No. 1996-9278, a sign device has a pair of separate sign panels, made from plastic materials, each of the sign panels is provided with a boss and a protrusion to be fittingly coupled each other. An insertion boss is formed at one of the sign panels to be fitted in the top portion of a post.

Although this traffic sign device has advantages of easy installation operation, free from corrosion, and acceptable appearance, the sign panels are apt to be disassembled by an external force since they are assembled by a simple fitting operation. Therefore, the sign panel of the sign device is also apt to be deformed due to its poor structural strength.

In the Korean Laid-open Utility Model Publication No.1998-9420, the sign device includes a first and second sign panels having a guide rail at their rear side. The guide rail is adapted to be coupled to a horizontal bar fixed to a post, by mean of a plurality of U-shaped bands.

On the other hand, the Korean Registered Utility Model Publication No. 20-0265849 and Japanese Laid-open Patent Publication No. H10-168835 disclose a sign device in which a sign board is provided at it rear side a separate cover for preventing exposure of the coupling part between the post hanger and the sign board.

However, since these sign boards must be fixed with relative to the post by means of the band and bolts, an operation of coupling the sign board on the post is considerably complicated. Also, in the case of the Korean Laid-open Utility Model Publication No. 1998-9420, since the bolt coupling parts of the sign board cannot be completely shielded by the cover, there still remains the problem of corrosion of the sign board components.

SUMMARY OF THE INVENTION

Accordingly, the present invention has been made keeping in mind the above problems occurring in the prior art, and an object of the present invention is to provide a traffic sign device which allows a sign board to be easily installed on a post, while minimizing the exposure of coupling part of the sign board.

Another object of the present invention is to provide a traffic sign device which improves structural strength of the sign board and enables efficient suppression of oxidization and corrosion of associated components, so as to permanently maintain its favorable appearance and to extend its service life.

A further object of the present invention is to provide a traffic sign device which allows a sign board to be easily and stably installed on a post, regardless of a size and a shape of the post.

In order to accomplish the above object, the present invention provides a sign device, which comprises: a post clamp including at least two arched clamping bands, which are hingedly coupled to each other at their adjacent ends and joined to each other by a fastening element at their free ends to be installed on a post; a support bar radially joined to one of the clamping bands of the post clamp to be horizontally positioned; and a sign board radially joined to one end of the support bar, the sign board includes a barrel shaped band frame having a coupling groove formed at its both peripheral edges, and a coupling slot formed at a circumferential surface of the band frame, through which the free end of the support bar passes and being fixed therein, and a front and rear covers having a skirt formed along the peripheral edge of the respective covers so that the skirt of the covers is fitted into the coupling groove of the band frame and a road sign is attached to the outside of the covers.

In accordance with the preferred feature of the present invention, the sign board further includes a coupling unit for fixing the free end of the support bar therein, the coupling unit includes: a reinforcing block having a T-shaped slot formed at the inside thereof to have a desired depth from its outer surface, and a coupling plate joined to the free end of the support bar so as to be fittingly inserted into the bottom portion of the T-shaped slot, and wherein the coupling plate is formed to have a width larger than the diameter of the support bar, and the reinforcing block is fixed inside the sign board such that the reinforcing block is interposed between the front and rear cover and both cutting surfaces of the reinforcing block are attached to the inner surface of the respective covers, by an adhesive.

In accordance with another feature of the present invention, the support bar is provided with a pair of screw holes axially formed on the inner surface thereof, and the support bar is coupled to the sign board such that the free end of the support bar is inserted into the coupling slot of the band frame, across the inside thereof, until the free end of the support bar is reached to an inner surface of the band frame, whereby screws are fitted into the screw holes of the support bar from outside of the band frame.

In accordance with a preferred feature of this invention, the support bar includes a socket pipe perpendicularly joined to on of the clamping bands of the post clamp by welding, the socket pipe being axially provided at its circumference with a plurality of spaced joint holes, and a movable pipe slidably inserted into the socket pipe with its one end joined to the sign board, the movable pipe being axially provided at its circumference with a plurality of spaced adjustment holes corresponding to the joint holes of the socket pipe, whereby the movable pipe is fixed to the socket pipe by tightening bolts through the joint holes and adjustment holes.

Preferably, the post clamp, the hanger and the sign board may be made of nonferrous metal excellent in corrosion resistance, such as aluminum and the like.

By the traffic sign device according to the present invention, a sign board is easily installed on a post by a simple operation of placing the post clamp on a post and joining the movable pipe fixed to the sign board into the socket pipe fixed to the post clamp by bolts and nuts, an operation of installing the sign board is much simplified.

Further, since the sign board is formed into a drum shape, and the joint portion relative to the support bar is positioned inside the sign board, the coupling part in the sign board is effectively prevented from being exposed. This allows the traffic sign device to have excellent structural strength enough to resist flexure and deformation, and to have an acceptable appearance for a long period of time, thereby contributing to visual improvement of the cityscape.

In addition, since associated components of the device are manufactured from nonferrous metal excellent in corrosion resistance, it is possible to prevent rusting and corrosion of the components, ensure favorable appearance of the structure, and extend a service life of the structure.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

This invention will be described in further detail by way of exemplary embodiments with reference to the accompanying drawings.

Referring to FIGS. 2 to 8 of the drawings, there is shown a traffic sign device according to one embodiment of the present invention.

As shown in FIGS. 2 to 5, the traffic sign device includes a post clamp 10 mounted on a post "P" perpendicularly installed on a roadside, a support bar 20 radially coupled to an outer surface of the post clamp 10 to be horizontally positioned, and a sign board 30 mounted on free end of the support bar 20 for exhibiting a designated road sign.

Figure 1A:
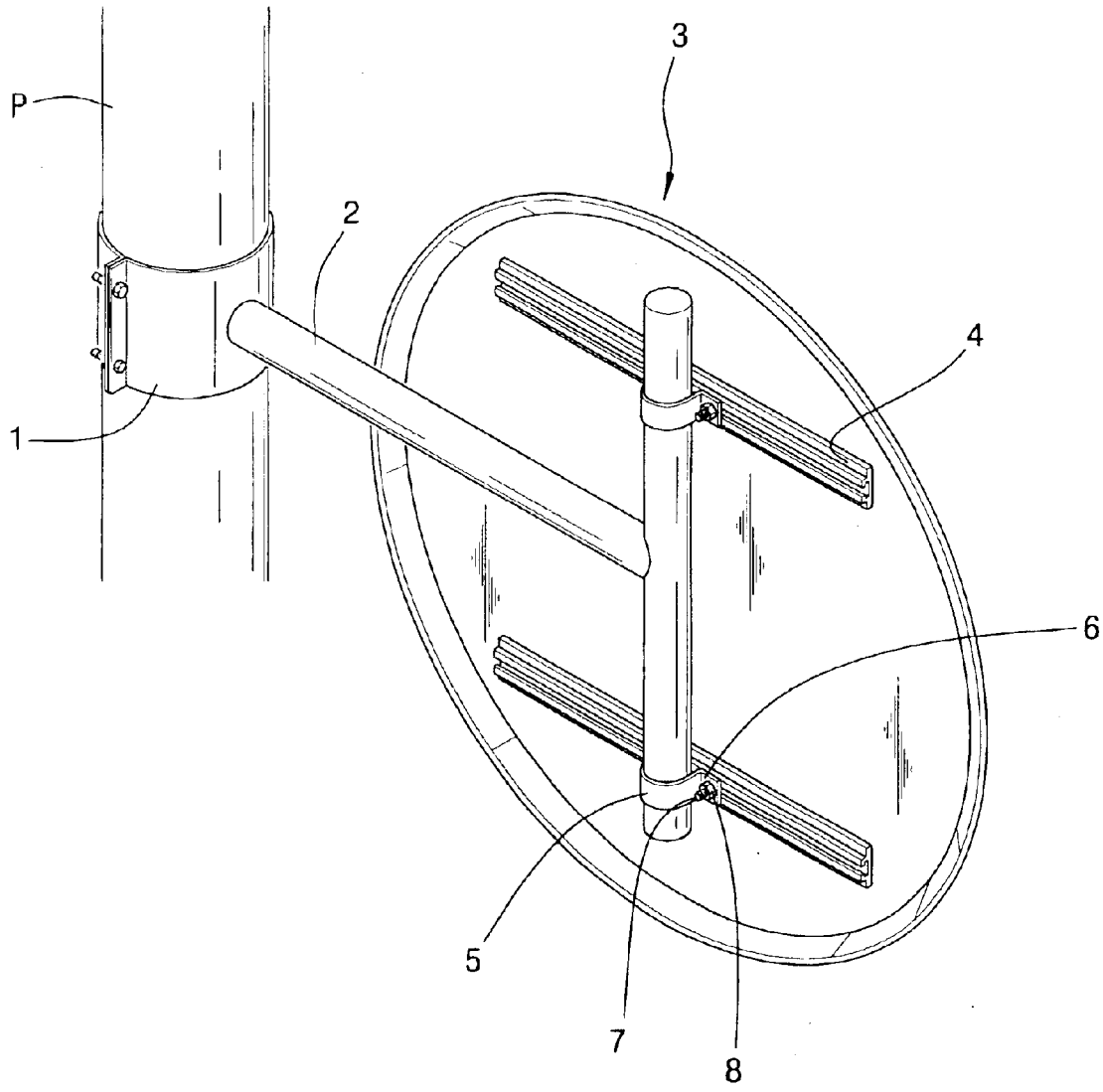
FIG. 1A is a perspective view of a conventional traffic sign device.
Figure 1B:
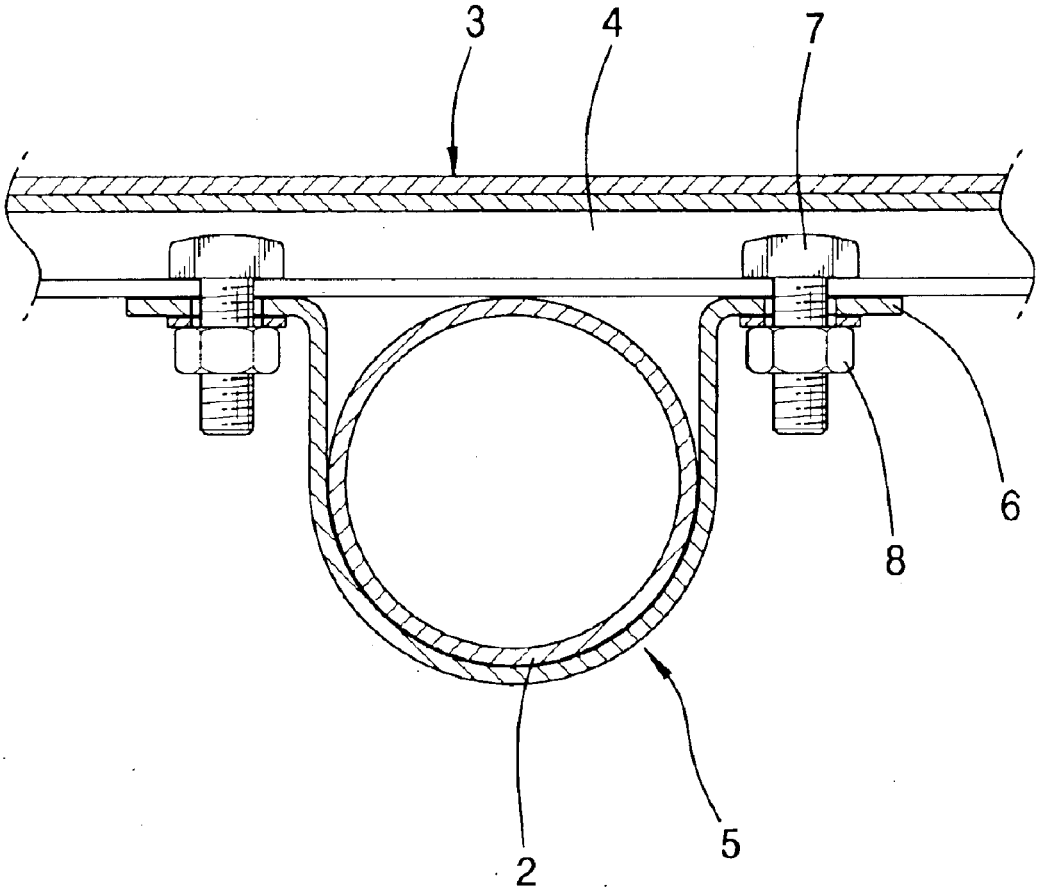
FIG. 1B is a plan cross-sectional view of the conventional traffic sign device of FIG. 1A, which is partially taken to illustrate coupling part of a sign board.
Figure 2:
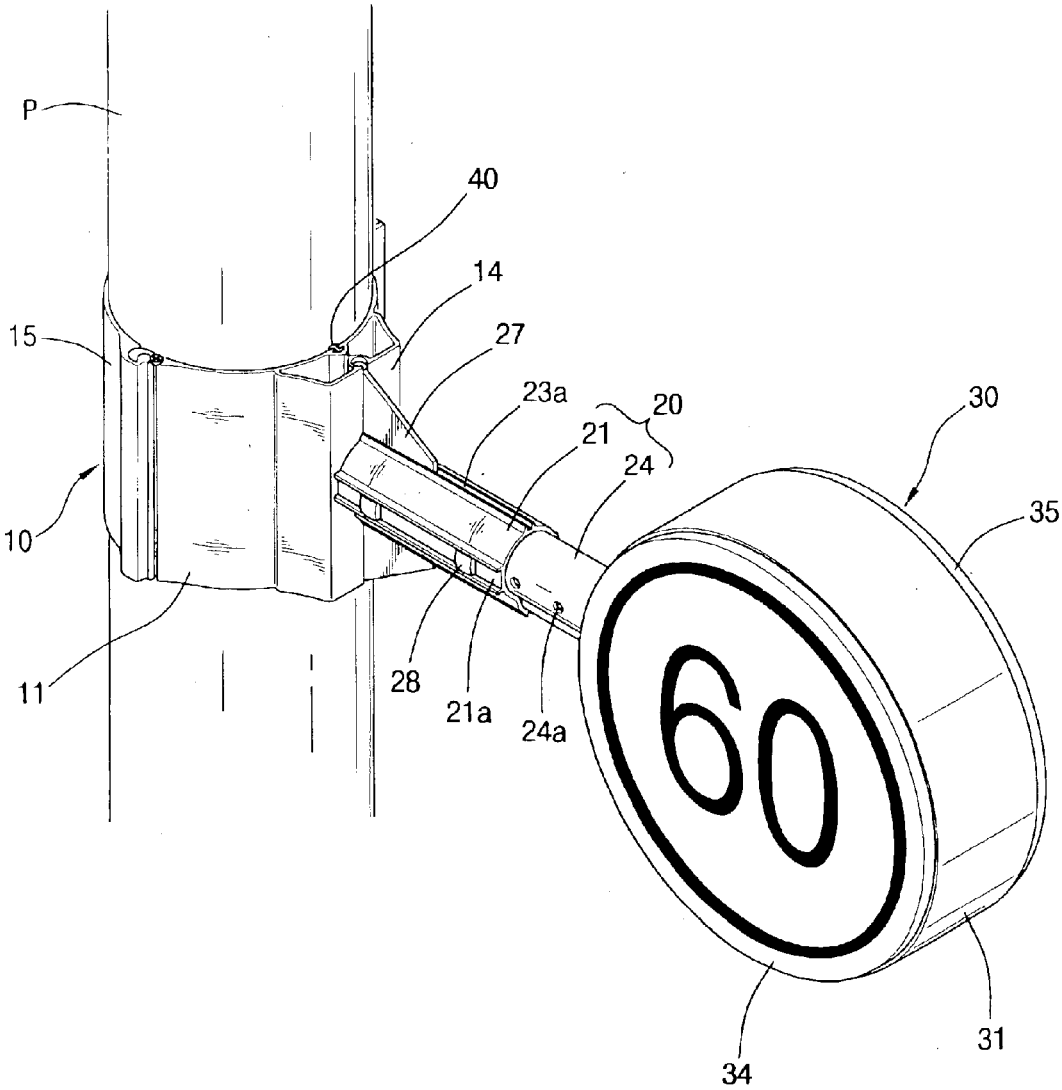
FIG. 2 is a perspective view of a traffic sign device according to one embodiment of the present invention, which is installed on a post.
Figure 3:
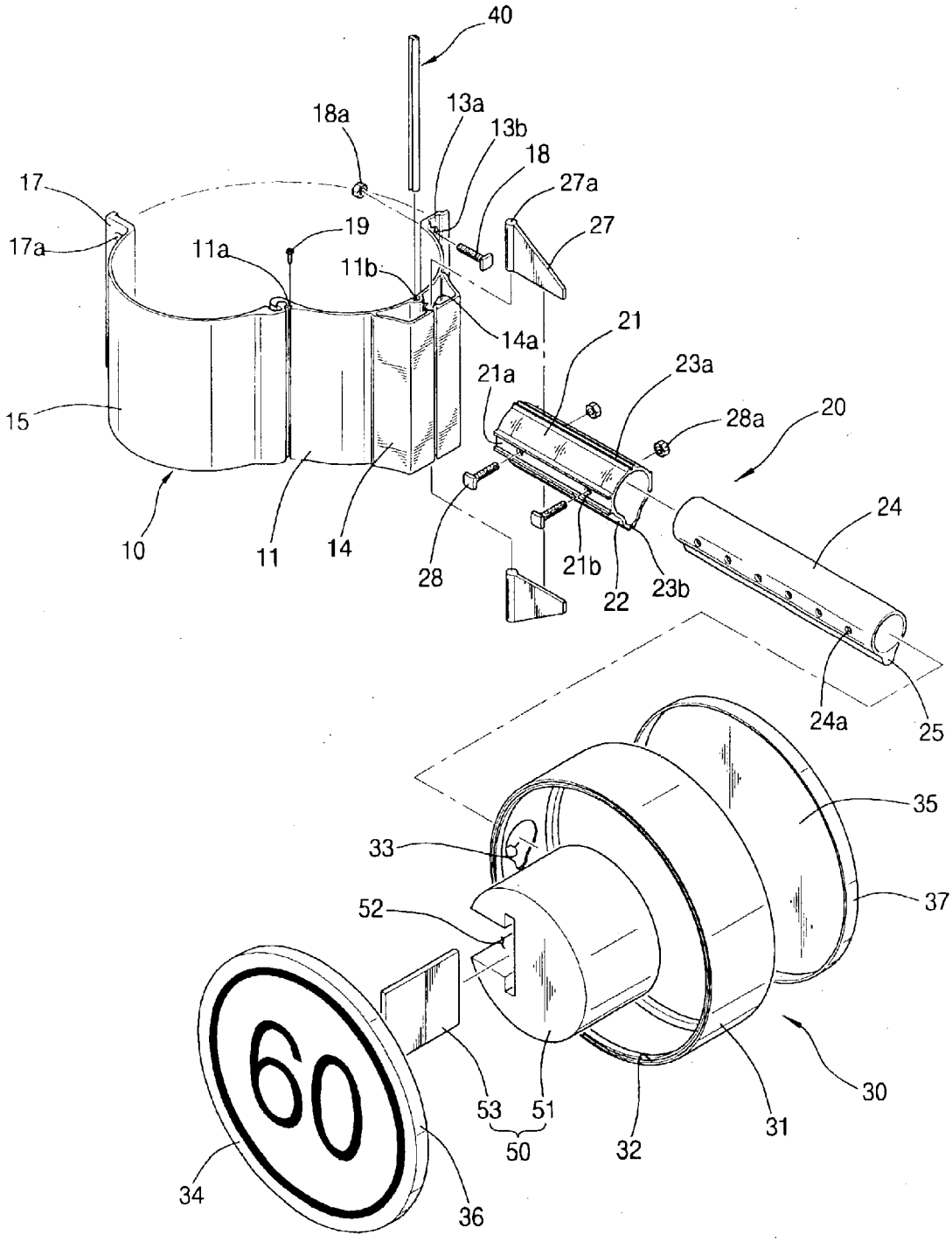
FIG. 3 is an exploded perspective view of the traffic sign device according to one embodiment of the present invention.
Figure 5:
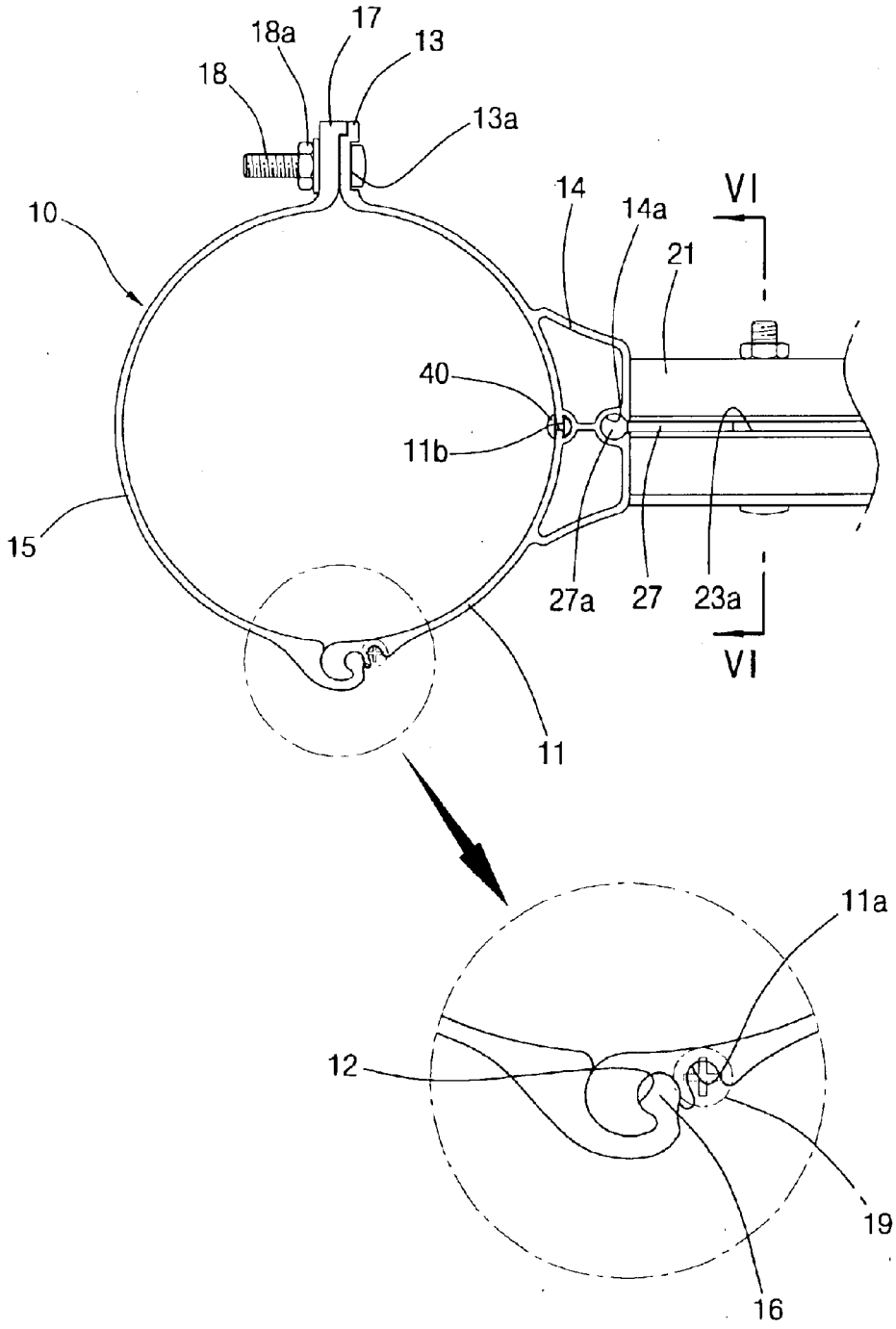
FIG. 5 is a plan view taken from the direction V of FIG. 4, which is partially enlarged.
Figure 6:
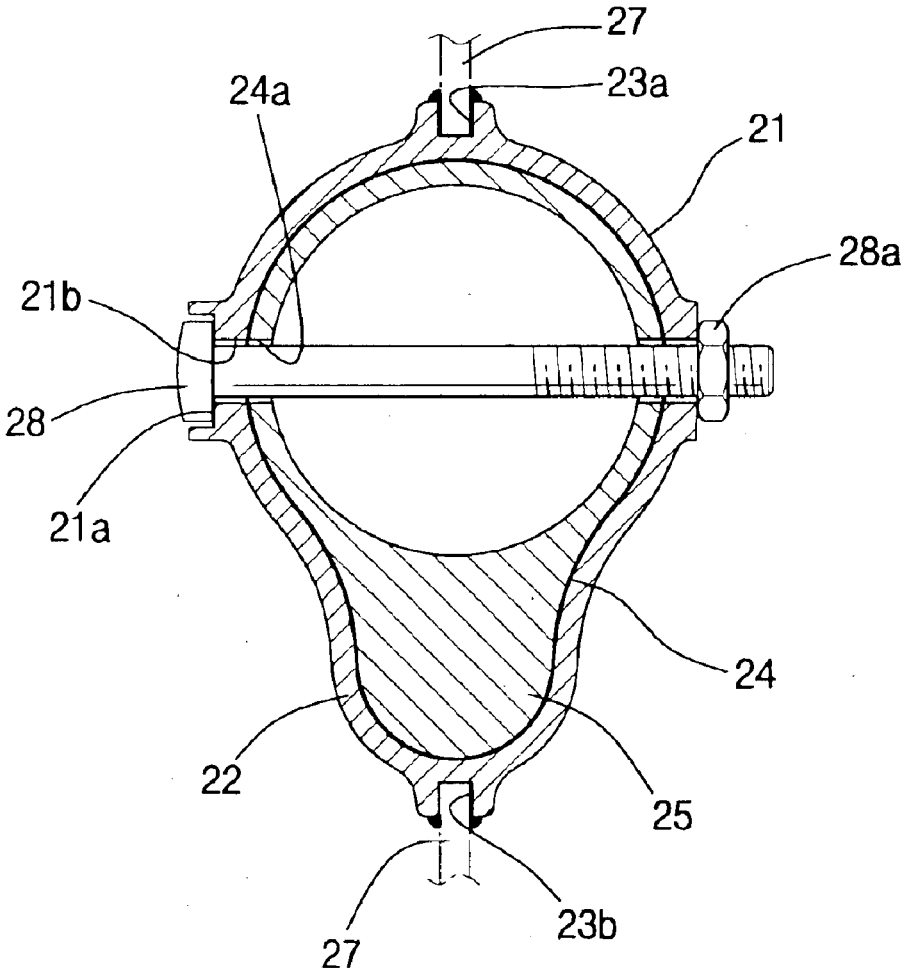
FIG. 6 is a cross-sectional view taken along line VI—VI of FIG. 5.

The post clamp 10 includes a pair of semicircular clamping bands 11 and 15, which is hingedly coupled to each other at their ends and fastened by bolts 18 and nuts 18*a* at their other ends, as illustrated in FIGS. 3 and 5.

As shown in detail in FIG. 5, the first clamping band 11 is provided at its end with a hinge groove 12 having a C-shaped cross section. The first clamping band 11 is further provided adjacent to the hinge groove 12 with a screw groove 11*a* having a C-shaped cross section, so that the screw groove 11*a* is engaged with retaining screws 19 at both ends to prevent separation of the second clamping band 15 from the hinge groove 12. More specifically, since the retaining screws 19 are partially embedded in the hinge groove 12 at their head portions, a hinge bulge 16 of the second clamping band 15 cannot be separated from the hinge groove 12.

Further, the first clamping band 11 is provided at the other end with a flange 13 having a plurality of joint holes 13*b* (See FIG. 3). The flange of the first clamping band 11 is provided at its outer surface with a channel-shaped bolt head seat 13*a*, as can be seen in FIG. 5, to prevent rotation of the head of bolts 18 inserted through the joint holes 13*b*.

Furthermore, the first clamping band 11 is provided at the center of its outer surface with a support land 14 protruded therefrom. This support land 14 is integrally formed with the first clamping band 11 to connect one end of the support bar 20 thereto and support the support bar 20. The center of the support land 14 is longitudinally provided with a coupling groove 14*a* having a C-shaped cross section to receive a pair of reinforcing ribs 27 (described hereinafter) thereinto.

Lastly, referring to FIG. 3, the first clamping band 11 is longitudinally provided at the center of its inner surface with a slit 11*b*, in which a rod-shaped contacting insert 40 is mounted to resiliently compress the post "P" when two clamping bands 11 and 15 are clamped around the post. The contacting insert 40 is provided against movement or rotation of the post 10 clamp 10 due to possible gap between the post clamp 10 and the post "P" occurring when the post is formed into a square shape.

Accordingly, configuration of the contacting insert 40 can be selected according to the shape of the post "P" in a detachable manner. In the case of a cylindrical post, even the diameter of the post clamp 10 is slightly larger than that of the post "P", the contacting insert 40 enables the post clamp 10 to be stably fixed to the post. Such a contacting insert is preferably manufactured from resilient material having a proper elasticity, such as India rubber and polyurethane.

The second clamping band 15 is provided at its end with the hinge bulge 16, which is fitted into the hinge groove 12 of the first clamping band 11, and is provided at the other end with a flange 17 having a plurality of joint holes 17*a*.

Although not shown in the drawings, the second clamping band 15 may have at its circumferential surface a slit similar to that of the first clamping band 11 so that the contacting insert 40 can be detachably mounted thereto, if necessary.

The above post clamp 10 is preferably manufactured from nonferrous metal excellent in corrosion resistance, such as aluminum material, by an extrusion process.

Turning to FIG. 3, the support bar 20 includes a socket pipe 21 joined to the support land 14 of the post clamp 10 by welding, and a movable pipe 24 slidably inserted into the socket pipe 21 and coupled thereto by bolts 28 and nuts 28*a*.

The socket pipe 21 is provided at its inner surface with a key channel 22 and the movable pipe 24 is provided at its outer surface with a key ridge 25 corresponding to the key channel 22, so that a position of the movable pipe 24 relative to the socket pipe 21 is established and a relative rotation between the socket pipe 21 and the movable pipe 24 is prevented.

The socket pipe 21 is axially provided at its outer surface with a channel-shaped bolt head seat 21*a* so as to prevent bolt heads 28 seated in the bolt head seat 21*a* from being rotated. The bolt head seat 21*a* includes two spaced joint holes 21*b*, so that bolts 28 are radially inserted into the joint holes 21*b*.

Preferably, a pair of reinforcing ribs 27 is coupled to the upper and lower sides of the socket pipe 21 so as to more stably support the socket pipe 21 welded to the support 1 and 14 of the post clamp 10.

Each of the reinforcing rib 27 is provided at its one edge with an enlarged coupling bulge 27*a*, which is fitted into a coupling groove 14*a* formed on the support land 14. The horizontal side of each reinforcing rib 27 is engaged with upper and lower support grooves 23*a* and 23*b*, which are axially formed on upper and lower surfaces of the socket pipe 21, and then fixed thereto by welding (denoted as black dots in FIG. 6).

The movable pipe 24 is sized to be relatively long comparing with the socket pipe 21, and is provided with a plurality of spaced joint holes 24*a* corresponding to the joint holes 21*b* of the socket pipe 21. With this, the extent of the support bar 20 can be adjusted by changing the position of the movable pipe 24 relative to the socket pipe 21.

Also, the support bar 20 is preferably manufactured from nonferrous metal excellent in corrosion resistance, such as aluminum material, by an extrusion process.

Figure 7:
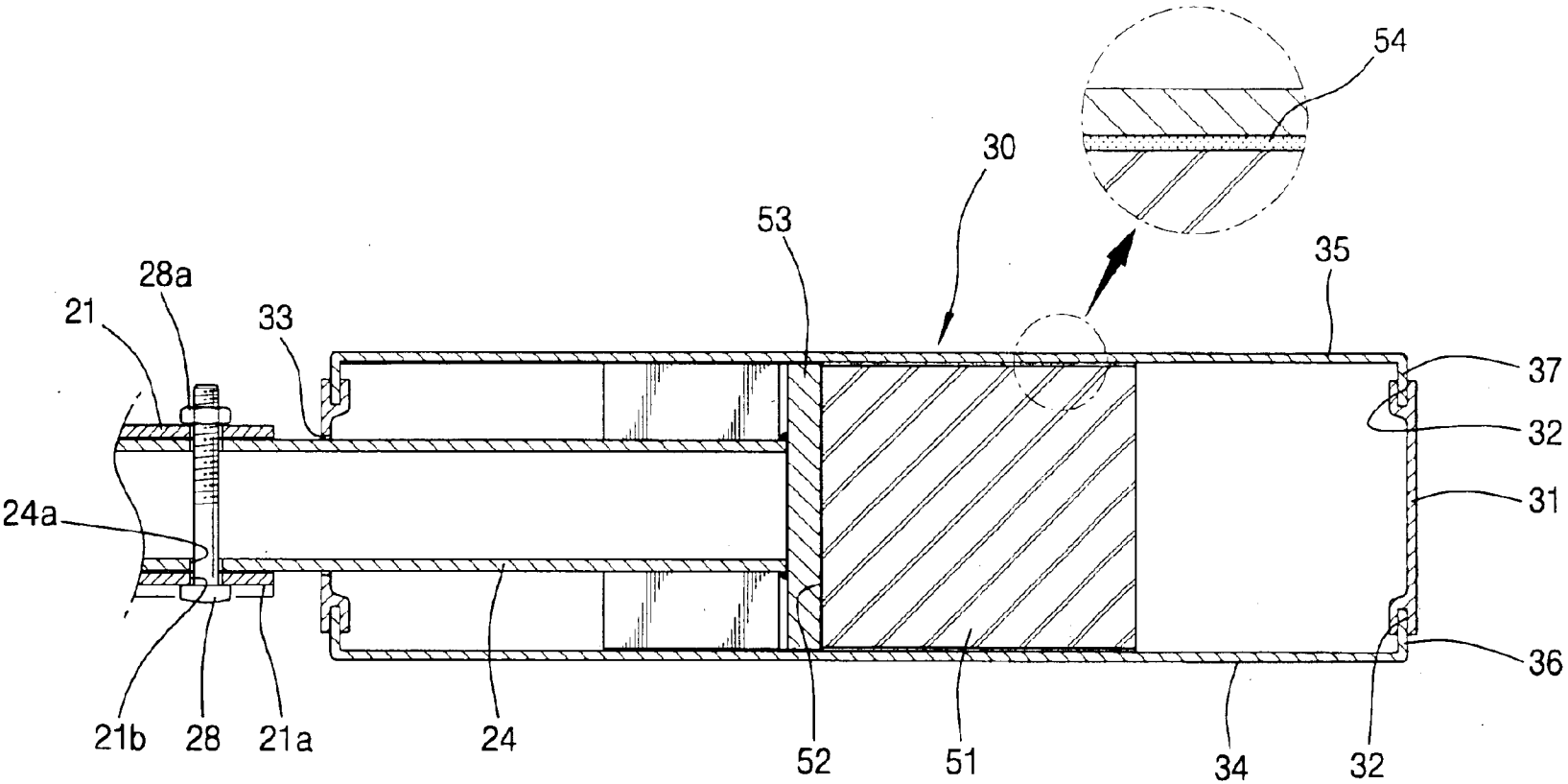
FIG. 7 is a partial cross-sectional view taken along line VII of FIG. 4.
Figure 8:
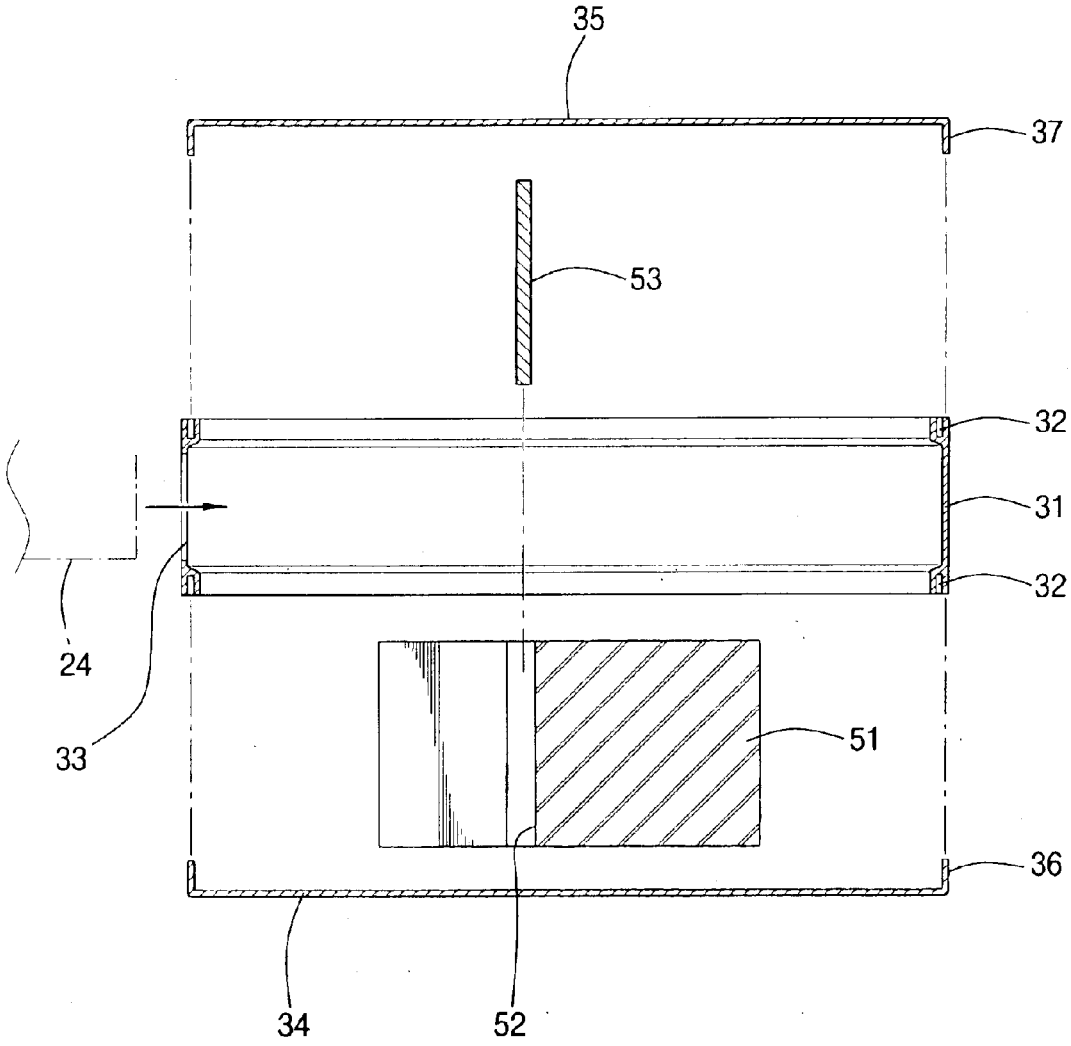
FIG. 8 is an exploded plan cross-sectional view showing assembling procedure of the sign board shown in FIG. 7.
Figure 9:
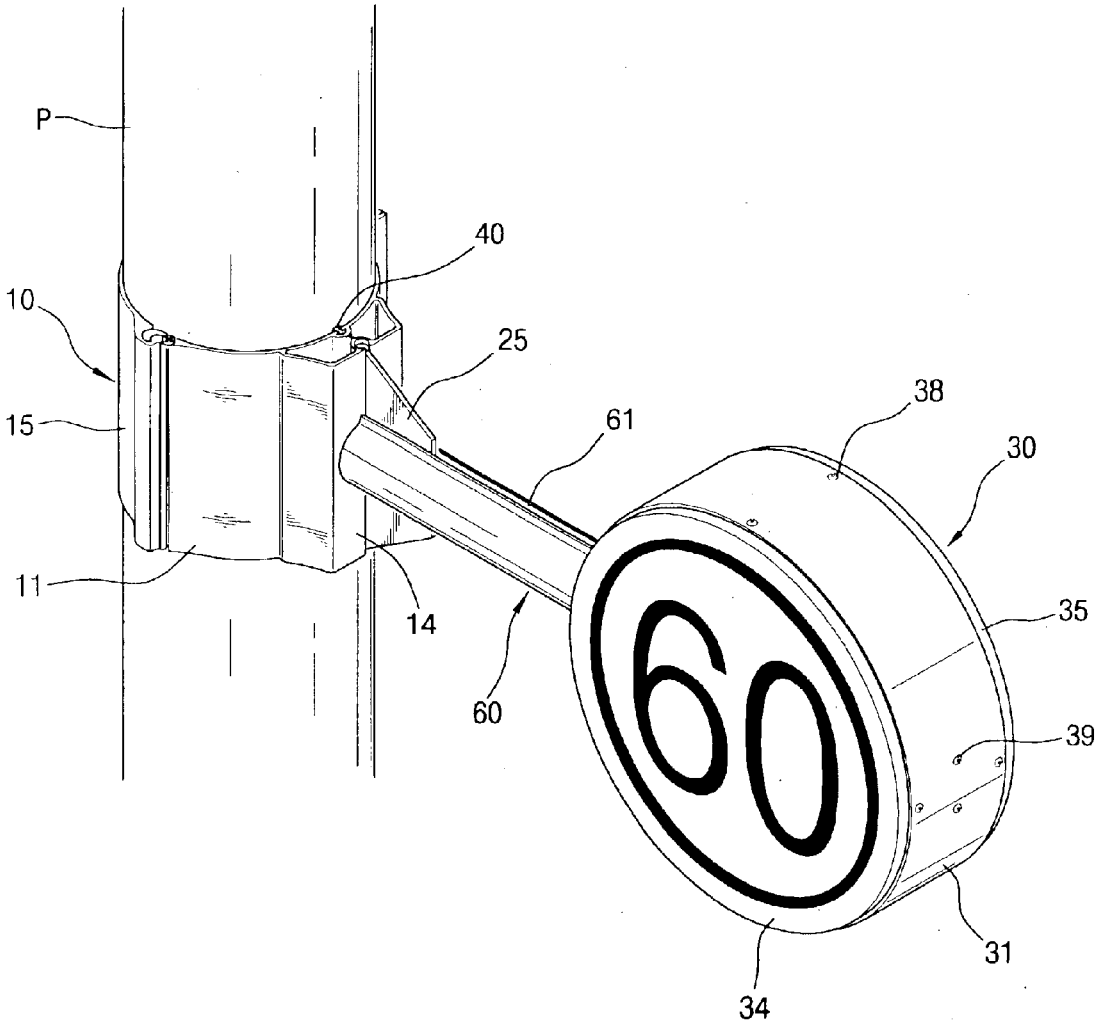
FIG. 9 is a perspective view of a traffic sign device according to another embodiment of the present invention, which is installed on a post.

Referring to FIGS. 3 and 7, there are shown a sign board according to this invention. The sign board 30 comprises a cylindrical band frame 31 and a front and rear cover 34 and 35, attached to both sides of the band frame 31.

The band frame 31 and the corresponding front and rear covers 34, 35 may be formed into any shape, such as a circle, a triangle, and a quadrangle, according to a kind of road sign stipulated in road safety rules.

The band frame 31 is provided at its both peripheral edges with a coupling groove 32, into which a skirt 36 of the front cover 34 and a skirt 37 of the rear cover 35 are forcibly fitted to couple the front and rear covers 34, 35 to the band frame 31. The band frame 31 is also provided at its circumferential surface a coupling slot 33, through which the free end of the movable pipe 24 of the support bar 20 passes.

The front and rear covers 34 and 35 are formed into a plane plate so that a road sign may be printed or attached to the outside of the covers. The skirts 36 and 37 are formed along peripheral edge of the respective covers 34 and 35.

The band frame 31 and covers 34 and 35 are preferably made of nonferrous metal excellent in corrosion resistance, such as aluminum material.

The sign board 30 is connected with the support bar 20 by means of a coupling unit 50 having a reinforcing block 51 and a coupling plate 53, as illustrated in FIGS. 3 and 7. The reinforcing block 51 is provided at its inside a T-shaped slot 52 to have a desired depth from its outer surface. The top opening of the T-shaped slot 52 is preferably set toward the coupling slot 33 of the band frame 31. The coupling plate 53 is joined to the free end of the movable pipe 24, by a welding, and is fittingly inserted into the bottom portion of the T-shaped slot 52. The coupling plate 53 is formed to have a width somewhat larger than the diameter of the movable pipe 24.

The reinforcing block 51 is fixed inside the sign board 30 such that the reinforcing block 51 is interposed between the front and rear cover 34 and 35 of the sign board 30, and both cutting surfaces of the reinforcing block 51 are attached to the inner surface of the covers 34 and 35, respectively, by an adhesive.

Accordingly, the reinforcing block 51 functions not only to connect the sign board 30 with the support bar 20 but also to fix the front and rear covers 34, 35 to the band frame 31. Of course, the reinforcing block 51 increases a structural strength of the sign board 30 as well as the covers 34 and 35.

Such a reinforcing block 51 is preferably made of light-weight polystyrene foam or synthetic resins, and the dimension of the reinforcing block 51 may be of a size that fully fills within the band frame 31, or as shown in the drawings, be of a proper size that receives the coupling plate 53 fixed to the movable pipe 24.

Though not shown in the drawings, the front and rear cover 34 and 35 may be more stably coupled to the band frame 31 by way of applying a screw or a weld onto a joint portion of the skirts 36, 37 fitted into the fitting grooves 32.

An operation of installing the sign device to the post by the structure according to the present invention will now be described.

First, the traffic sign device is manufactured into two unit assemblies including the post clamp 10 and the sign board 30. In the first assembly, the socket pipe 21 of the support bar 20 is joined to the support land 14 of the post clamp 10 by welding process. In the second assembly, the movable pipe 24 of the support bar 20 is joined to the sign board 30 by means of the coupling unit 50, as described above.

Figure 4:
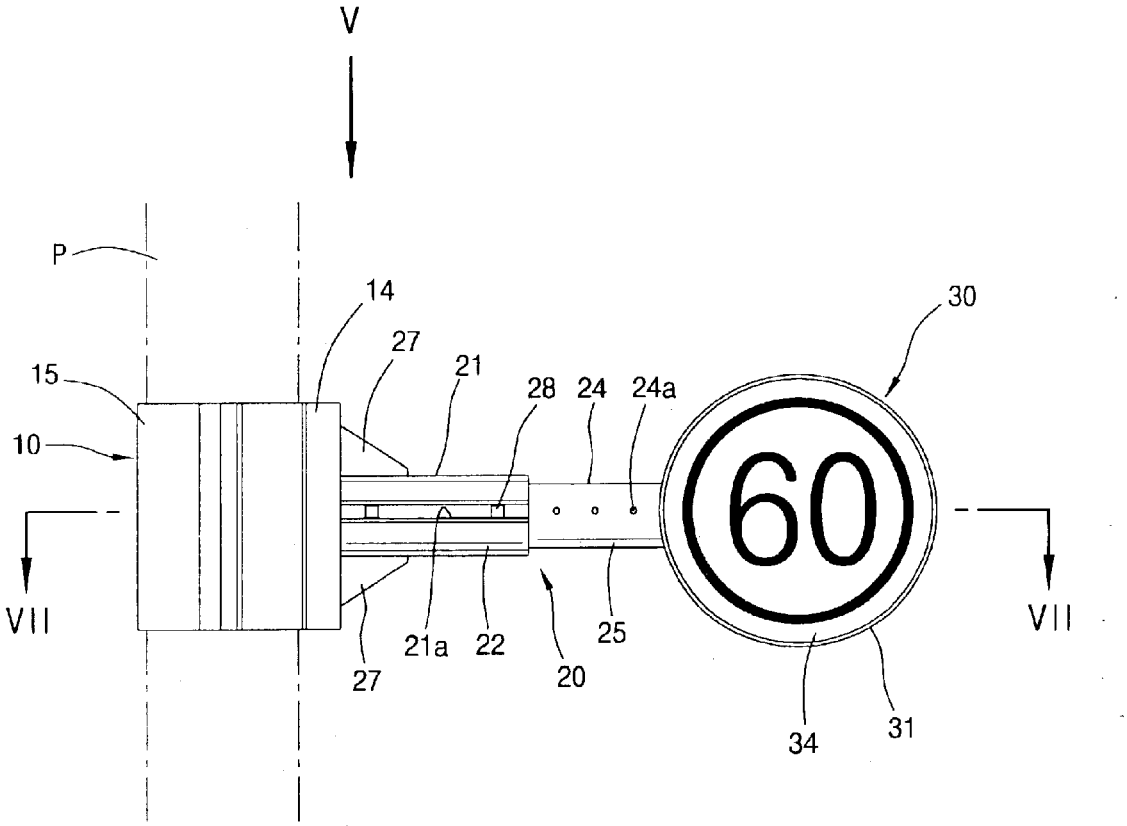
FIG. 4 is a side elevation view of the traffic sign device, which illustrates assembled state of the sign device shown in FIG. 3.

Accordingly, after transportation of the two unit assemblies to a site, the installing operation can be easily accomplished by coupling the post clamp 10 to a post, simply inserting the movable pipe 24 fixed to the sign board 30 into the socket pipe 21 joined to the post clamp 10, and positioning the movable pipe 24 to have a desired extension by fastening the bolts 28 and nuts 28*a* on the socket pipe 21, as shown in FIG. 4.

With the above-mentioned structure, since the post clamp 10 is comprised of two arched clamping bands 11, 15 hingedly coupled to each other, the post clamp 10 is easily installed on the post, and thus the sign board can be more easily installed on the post. Also, in consideration of a road circumstances, the fixing position of the movable pipe 24 relative to the socket pipe 21 is adjusted to allow the sign board 30 to have an optimum viewing position.

Particularly, since the sign board 30 is formed into a drum shape including the reinforcing block 51, and the joint portion relative to the support bar 20 is positioned inside the sign board 30, the coupling part in the sign board 30 is effectively prevented from being exposed. This allows the traffic sign device to have excellent structural strength enough to resist flexure and deformation due to external force, and to have an acceptable appearance for a long period of time, thereby contributing to visual improvement of the cityscape.

Further, since components of the traffic sign device of this invention is manufactured from rust-resistant materials, the sign device can permanently preserve its original adaptable appearance without needing subsequent painting, and its reparability and service life are considerably improved.

Referring again to FIG. 9 to FIG. 13 of the drawings, there is shown a second embodiment of the traffic sign device according to the present invention.

Similar to the first embodiment, the traffic sign device includes a post clamp 10 mounted on a post "P", a support bar 60 radially joined to an outer surface of the post clamp 10 to be horizontally positioned, and a sign board 30 mounted on free end of the support bar 60 to exhibit a road sign.

In this embodiment, since the configuration of the post clamp 10 is exactly same as that of the first embodiment, the details of the post clamp 10 will be omitted for brevity's sake.

The support bar 60 of the second embodiment is formed into a single body to have a proper length. The support bar 60 is provided with a pair of coupling grooves 61 and 62, which is axially formed on upper and lower outer surfaces of the support bar 60. Further, the support bar 60 is provided with a pair of screw holes 63, which is axially formed on the inner surface thereof to be faced with the coupling grooves 61 and 62.

The screw holes 63 is made by forming a boss 64 having a C-shaped cross-section, during an extrusion process of the support bar 60, and tapping the inner surface of the support bar 60.

Preferably, a pair of reinforcing ribs 65 is provided to more stably support the support bar 60, as is in the first embodiment. Each of the reinforcing rib 65 is provided at its one edge with an enlarged coupling bulge 65*a*, which is fitted into a C-shaped coupling groove 14*a*, formed on the support land 14.

The horizontal side of each reinforcing rib 65 is fitted into the upper and lower coupling grooves 61 and 62, and then fixed thereto by welding (denoted as black dots in FIG. 12) in order to increase a structural strength of the joint portion between the post clamp 10 and the support bar 60.

The sign board 30 also comprises a cylindrical band frame 31 and a front and rear cover 34 and 35, attached to both sides of the band frame 31, as similar to the first embodiment. However, in this embodiment, there is simply omitted some components as provided in the first embodiment. Omitted are the reinforcing block 51 and the coupling plate 53, which constitute the coupling unit 50 of the first embodiment. Therefore, for the brevity's sake, the details of the sign board 30 will be omitted, and only the different part, that is, the assembling process of the components and the fixing process relative to the support bar 60 will be described herein, where the same components depicted in the first embodiment are denoted by the same reference number.

In the second embodiment, the sign board 30 is assembled such that, after fitting the skirt 36, 37 of the front and rear cover 34, 35 into the coupling grooves 32 of the band frame 31, a plurality of screws 38 is tightened along both edge portions of the band frame 31 at a constant interval, in which the skirt 36, 37 of the front and rear cover and the band frame 31 are overlapped. Instead of the screws 38, the edge portion of the band frame 31 may be secured by a spot welding process.

Figure 10:
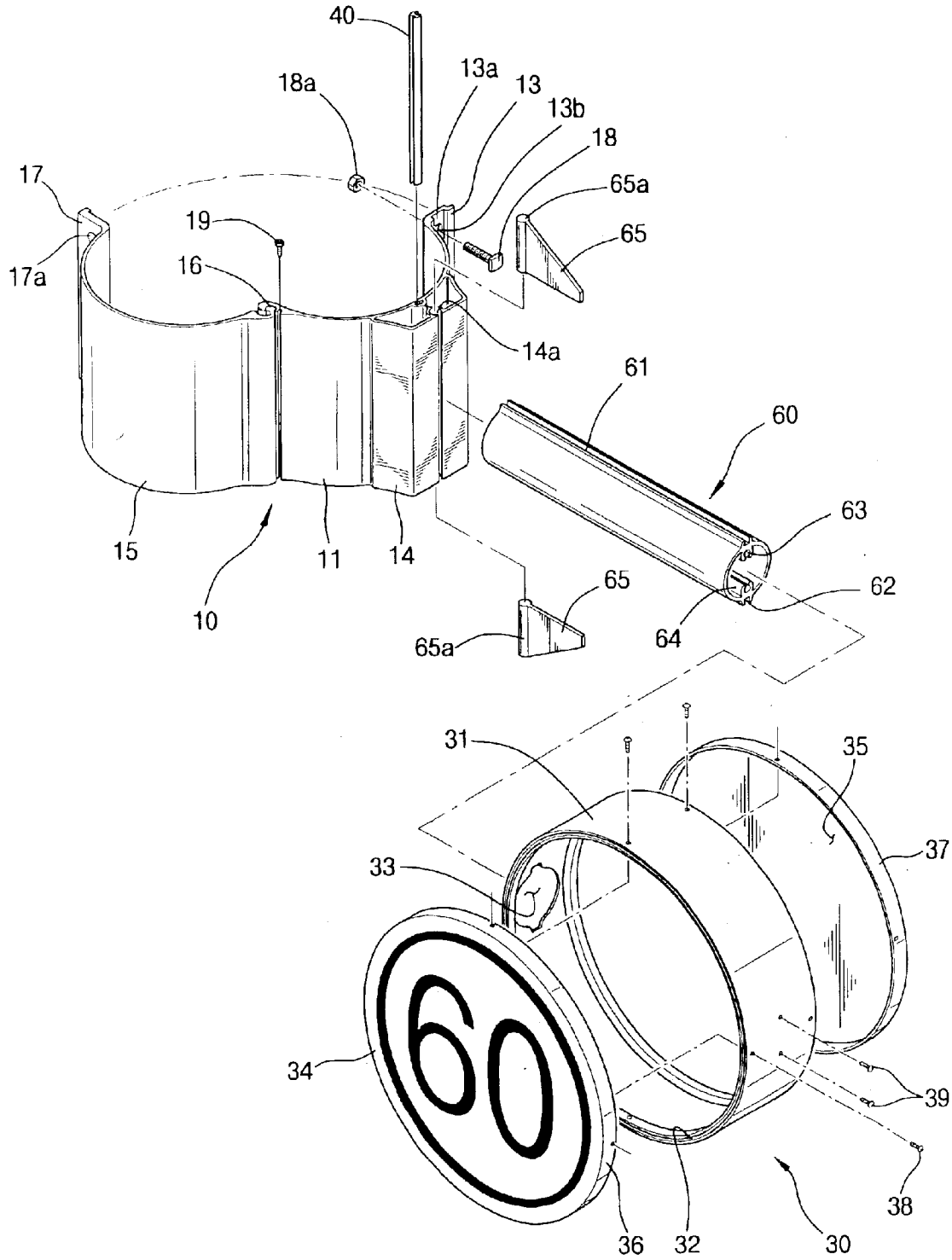
FIG. 10 is an exploded perspective view of the traffic sign device according to another embodiment of the present invention.
Figure 11:
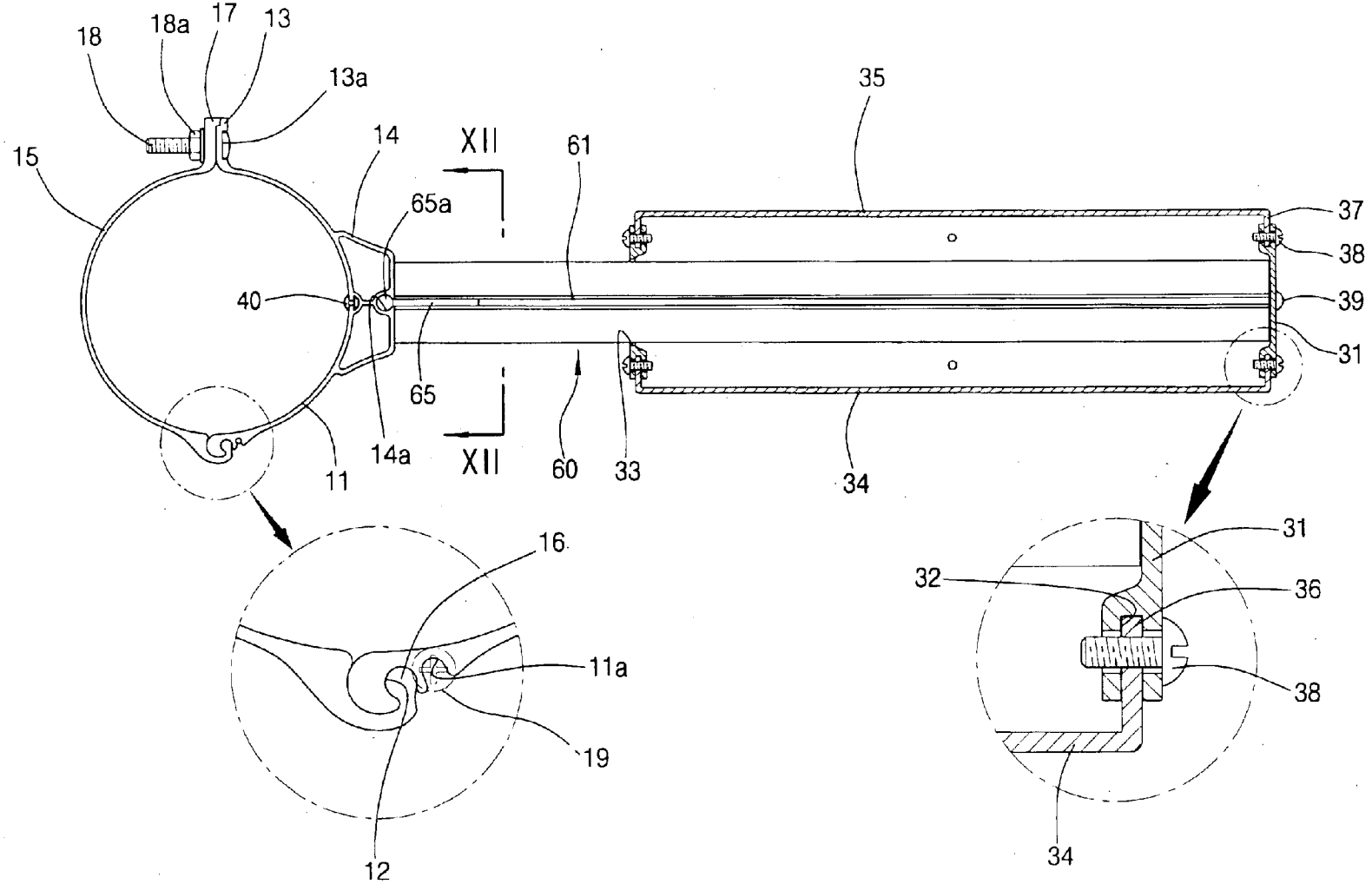
FIG. 11 is a plan cross-sectional views showing assembled state of the sign device shown in FIG. 10.
Figure 12:
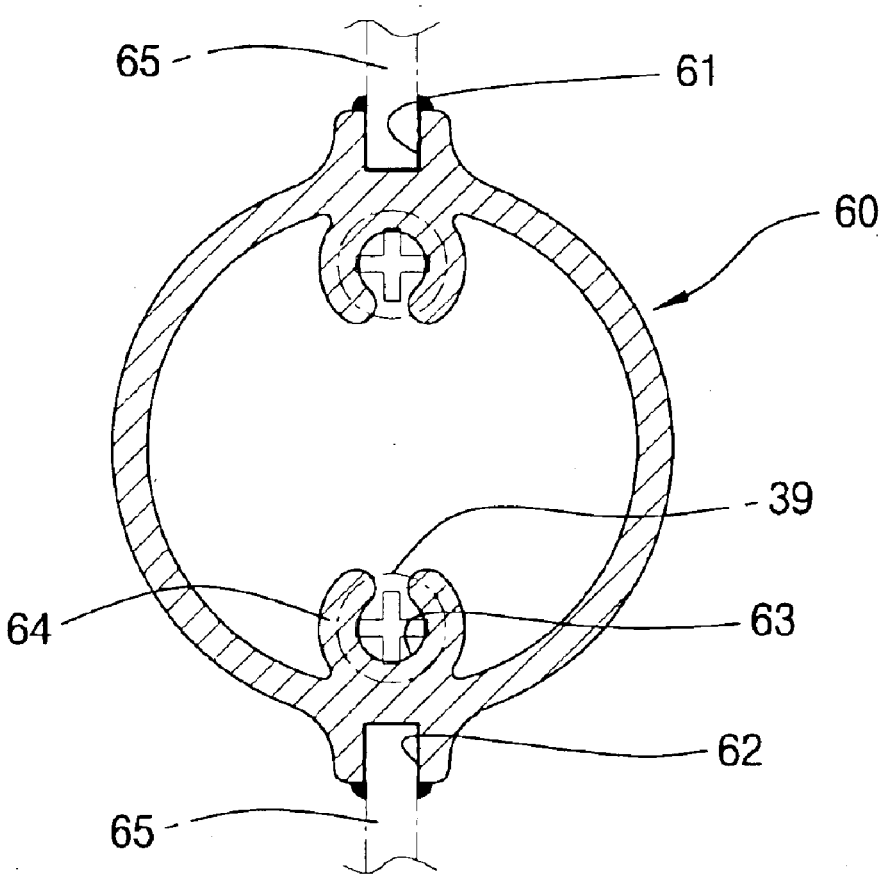
FIG. 12 is a cross-sectional view taken along line XII—XII of FIG. 11.
Figure 13:
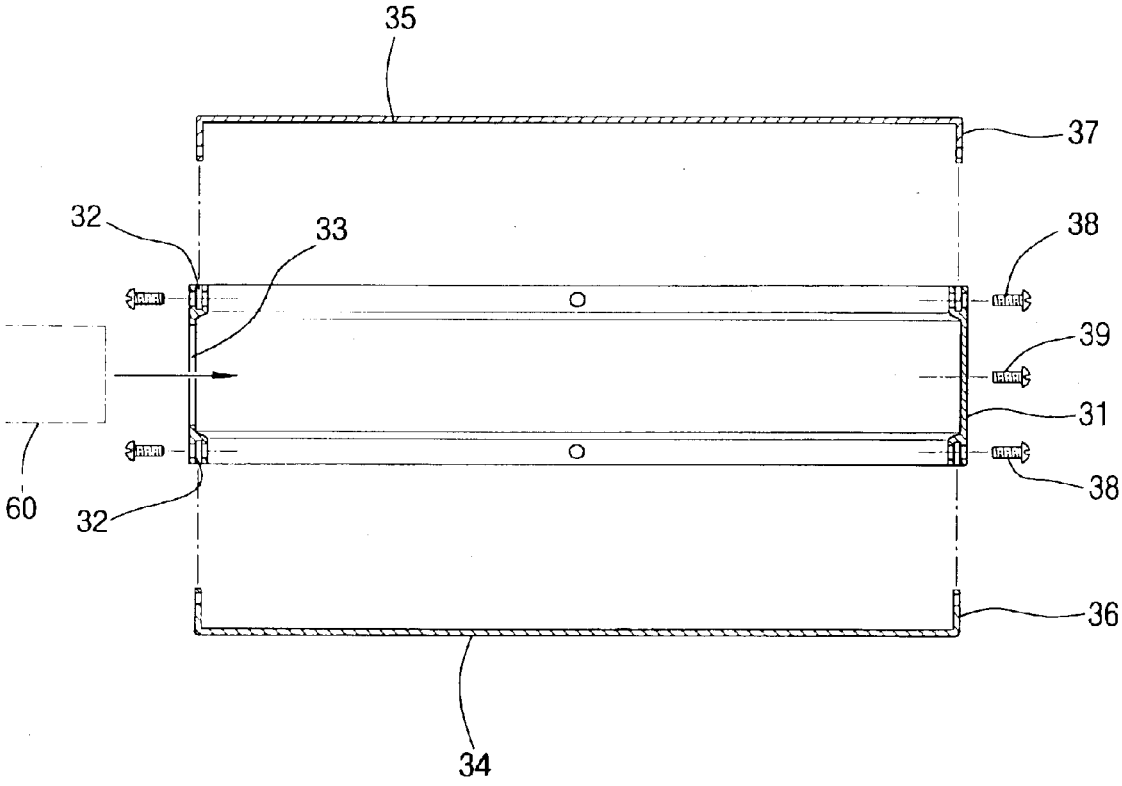
FIG. 13 is an exploded plan cross-sectional view showing assembling procedure of the sign board according to another embodiment of the present invention.

Next, the assembled sign board 30 is fixed to the support bar 60 such that the free end of the support bar 60 is inserted into the coupling slot 33 of the band frame 31, across a line of its diameter, until the free end of the support bar 60 is reached to an inner surface of the band frame 31, so that the screw holes 63 of the support bar 60 may be fastened by two screws 39 from outside of the band frame 31. The tightening up position of the screws 39 in the periphery of the band frame 31 is indicated by holes, formed around center portion thereof and faced to the coupling slot 33, as shown in FIG. 10. Also, instead of the screws 39 that fasten the sign board 30 to the support bar 60, a welding process can be applied to a place at which the band frame 31 contacts the free end of the support bar 60.

In this embodiment, since the free end of the support bar 60 is fixed to the band frame 31 of the sign board 30 across the inside thereof, more stable support for the sign board assembly is maintained.

Figure 14:
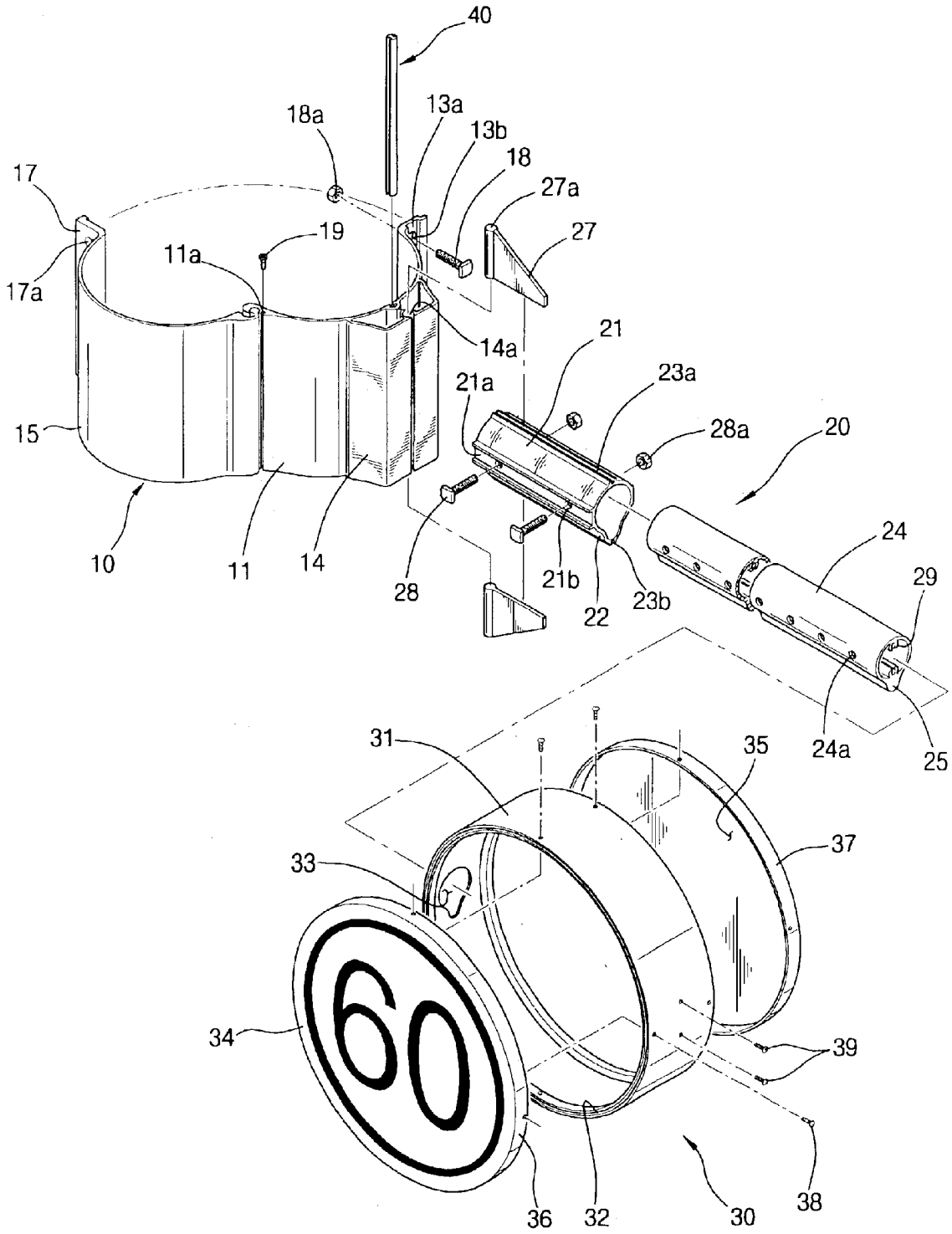
FIG. 14 is an exploded perspective view showing further embodiment of a hanger according to the present invention.

FIG. 14 shows further embodiment of the traffic sign device according to the present invention. The traffic sign device includes a post clamp 10 mounted on a post "P", a support bar 20 radially joined to an outer surface of the post clamp 10 to be horizontally positioned, and a sign board 30 mounted on free end of the support bar 20 to exhibit a road sign.

In this embodiment, since the configuration of the post clamp 10 is exactly same as that of the first embodiment, the details of the post clamp 10 will be omitted for brevity's sake.

Similar to the support bar 20 in the first embodiment, the support bar 20 includes a socket pipe 21 joined to the support land 14 of the post clamp 10 by welding, and a movable pipe 24 slidably inserted into the socket pipe 21 and coupled thereto by bolts 28 and nuts 28*a*. However, the movable pipe 24 is different from the first embodiment in that it is further provided at inner surface thereof with a pair of screw holes 29, as like the screw holes 63 of the support bar 60 illustrated in the second embodiment.

The rest of the support bar 20 has the same configuration as the first embodiment. Also, the configuration of the sign board 30 is exactly same as that of the second embodiment. Therefore, the details of the support bar 20 as well as the sign board 30 will be omitted for brevity's sake.

Figure 15:
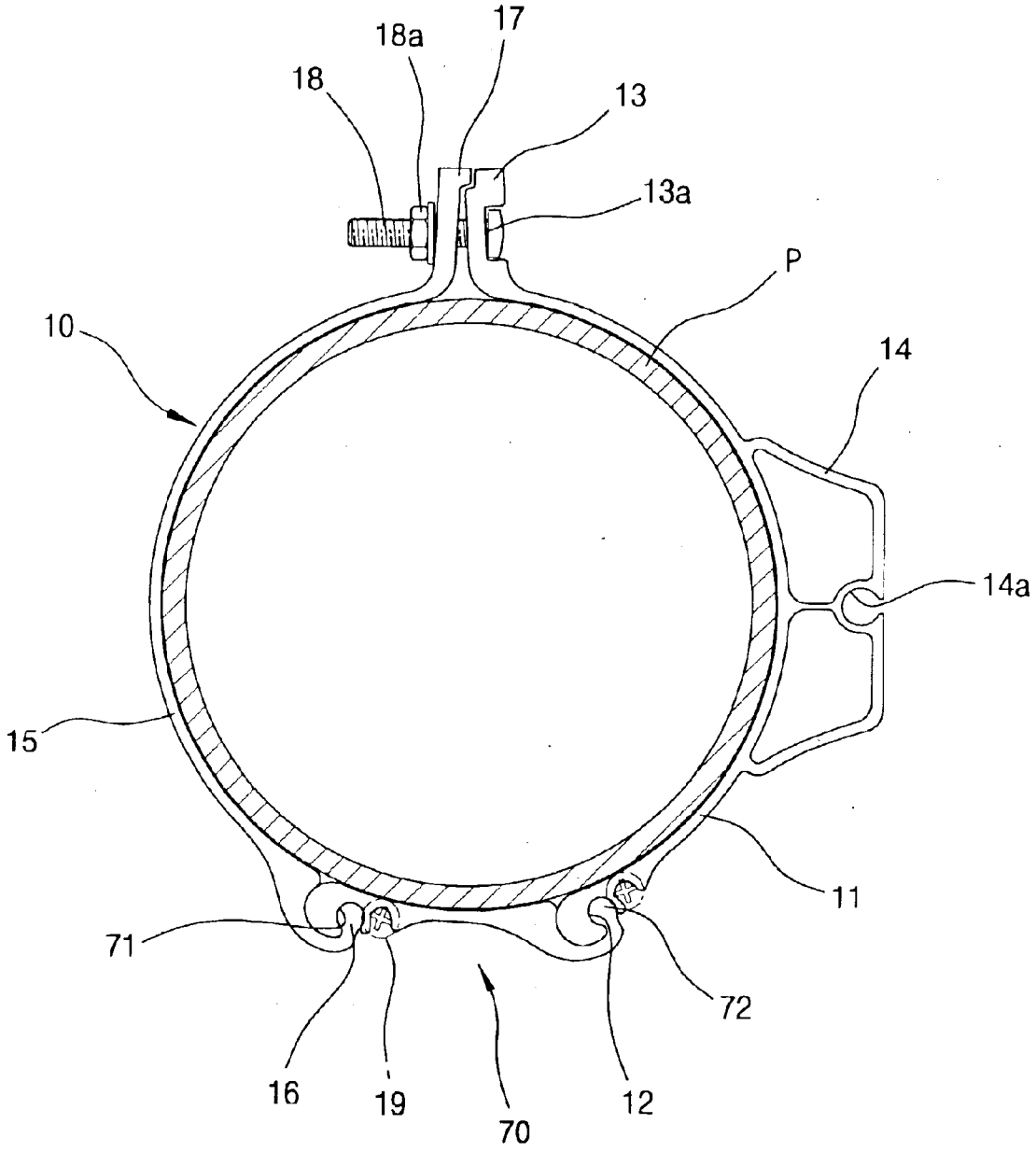
FIG. 15 is a plan view showing further embodiment of a post clamp according to the present invention.

FIG. 15 shows further embodiment of the post clamp 10 according to the present invention. This post clamp 10 is different from the previous embodiment in that it further includes at least an auxiliary clamping band 70, which is positioned between the first and second clamping bands 11 and 15, and is provided at its opposite ends with a hinge groove 71 and a hinge bulge 72, which correspond to the hinge bulge 16 and the hinge groove 12 of the first and second clamping band 11 and 15. Preferably, the auxiliary clamping band 70 has a circumference smaller than that of any of the first and second clamping bands.

According to this embodiment, since the first and second clamping bands 11 and 15 may be coupled to each other with the auxiliary clamping band 70 interposed there between in response to a diameter of the post "P", the post clamp 10 can be easily installed on various posts "P", regardless of a diameter of the post.

In the above-mentioned embodiments, the component of the traffic sign device may be manufactured from high strength synthetic resins, such as a reinforced plastic material, instead of nonferrous metal.

As described above, according to the traffic sign device of this invention, since the sign board 30 can be easily installed on a post by a simple operation of placing the post clamp 10 on the post and joining the movable pipe 24 fixed to the sign board 30 into the socket pipe 21 fixed to the post clamp 10 by bolts and nuts, an operation of installing the sign board is simplified.

Further, since the sign board 30 is formed into a drum shape, and the joint portion relative to the support bar 20 is positioned inside the sign board 30, coupling part in the sign board 30 is effectively prevented from being exposed. This allows the traffic sign device to have excellent structural strength enough to resist flexure and deformation due to external force, and to have an acceptable appearance for a long period of time, thereby contributing to visual improvement of the cityscape.

According to the present invention, since associated components of the structure are manufactured from nonferrous metal excellent in corrosion resistance, it is possible to prevent rusting and corrosion of the component, thereby ensuring favorable appearance of the sign device as well as its extended service life.

Furthermore, according to further embodiment of this invention, the sign device can selectively adopt auxiliary clamping bands according to a diameter of a post, whereby the post clamp can be easily installed on the post.

Accordingly, the present invention has advantages in that working efficiency at a post site is improved, and extension of a service life of the sign device and beautification of a road environment are achieved.

Although preferred embodiments of the present invention have been described for illustrative purposes, those skilled in the art will appreciate that various modifications, additions and substitutions are possible, without departing from the scope and spirit of the invention as defined in the accompanying claims.

What is claimed is:

1. A traffic sign device, comprising:

a post clamp including at least two arched clamping bands, which are hingedly coupled to each other at their adjacent ends and joined to each other by a fastening element at their free ends to be installed on a post;

a support bar radially joined to one of the clamping bands of the post clamp to be horizontally positioned; and a sign board radially joined to one end of the support bar, the sign board includes a barrel-shaped band frame having a coupling groove formed at its both peripheral edges, and a coupling slot formed at a circumferential surface of the band frame, through which the free end of the support bar passes and being fixed therein, and a front and rear covers having a skirt formed along the peripheral edge of the respective covers so that the skirt of the covers is fitted into the coupling groove of the band frame and a road sign is attached to the outside of the covers.

2. The traffic sign device as set forth in claim 1, wherein the sign board further includes a coupling unit for fixing the free end of the support bar therein, the coupling unit includes: a reinforcing block having a T-shaped slot formed at the inside thereof to have a desired depth from its outer surface, and a coupling plate joined to the free end of the support bar so as to be fittingly inserted into the bottom portion of the T-shaped slot, and wherein the coupling plate is formed to have a width larger than the diameter of the support bar, whereby the reinforcing block is fixed inside the sign board such that the reinforcing block is interposed between the front and rear cover and both cutting surfaces of the reinforcing block are attached to the inner surface of the respective covers by an adhesive.

3. The traffic sign device as set forth in claim 1, wherein the support bar includes a socket pipe perpendicularly joined to one of the clamping bands of the post clamp by welding, the socket pipe being axially provided at its circumference with a plurality of spaced joint holes, and a movable pipe slidably inserted into the socket pipe with its one end joined to the sign board, the movable pipe being axially provided at its circumference with a plurality of spaced adjustment holes corresponding to the joint holes of the socket pipe, whereby the movable pipe is fixed to the socket pipe by tightening bolts through the joint holes and adjustment holes.

4. The traffic sign device as set forth in claim 3, wherein the socket pipe is provided at its inner surface with a key channel, and the movable pipe is provided at its outer surface with a key ridge corresponding to the key channel, whereby a position of the movable pipe relative to the socket pipe is established and a relative rotation between the socket pipe and the movable pipe is prevented.

5. The traffic sign device as set forth in claim 4, wherein the sign board further includes a coupling unit for fixing the free end of the support bar therein, the coupling unit includes: a reinforcing block having a T-shaped slot formed at the inside thereof to have a desired depth from its outer surface, and a coupling plate joined to the free end of the support bar so as to be fittingly inserted into the bottom portion of the T-shaped slot.

6. The traffic sign device as set forth in claim 1, wherein the post clamp is provided with a rod-shaped contacting insert made of resilient material to resiliently compress the post when the first and second clamping bands are clamped around the post.

7. The traffic sign device as set forth in claim 1, wherein the post clamp further includes at least one auxiliary clamping band coupled between the first and second clamping bands, which is provided at its opposite ends with a hinge groove and a hinge bulge corresponding to each other, whereby the auxiliary clamping band is selectively coupled between the first and second clamping bands according to a size of the post.

8. The traffic sign device as set forth in claim 7, wherein the post clamp is provided with a rod-shaped contacting insert made of resilient material to resiliently compress the post when the first and second clamping bands are clamped around the post.

9. The traffic sign device as set forth in claim 1, wherein the post clamp, the support bar and the sign board comprise a corrosion resistant.

10. The traffic sign device as set forth in claim 1, wherein the support bar is provided with a pair of screw holes axially formed on the inner surface thereof, and the support bar is coupled to the sign board such that the free end of the support bar is inserted into the coupling slot of the band frame, across the inside thereof, until the free end of the support bar is reached to an inner surface of the band frame, whereby screws are fitted into the screw holes of the support bar from outside of the band frame.

11. The traffic sign device as set forth in claim 10, wherein the front and rear cover are fixed to the band frame such that, after fitting the skirt of the front and rear cover into the coupling grooves of the band frame, a plurality of screws is fixed along both edge portions of the band frame at a constant interval, in which the skirt of the front and rear cover and the band frame are overlapped.

12. The traffic sign device as set forth in claim 10, wherein the support bar includes a socket pipe joined to the outer surface of the post clamp by welding, the socket pipe being axially provided at its circumference with a plurality of spaced joint holes, and a movable pipe slidably inserted into the socket pipe with its free end joined to the sign board, the movable pipe being axially provided at its circumference with a plurality of spaced adjustment holes corresponding to the joint holes of the socket pipe, and with a pair of screw holes formed on the inner surface thereof, whereby the movable pipe is positioned in the socket pipe by fixing bolts and nuts through the joint holes and adjustment holes.

13. The traffic sign device as set forth in claim 12, wherein the socket pipe is provided at its inner surface with a key channel, and the movable pipe is provided at its outer surface with a key ridge corresponding to the key channel, whereby a position of the movable pipe relative to the socket pipe is established and a relative rotation between the socket pipe and the movable pipe is prevented.

* * * * *